US009299549B2

(12) United States Patent
Campbell et al.

(10) Patent No.: US 9,299,549 B2
(45) Date of Patent: Mar. 29, 2016

(54) GENERATION OF REAGENT IONS FOR ION-ION REACTIONS

(71) Applicant: DH Technologies Development Pte. Ltd., Singapore (SG)

(72) Inventors: John Lawrence Campbell, Milton (CA); Yves LeBlanc, Newmarket (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/367,236

(22) PCT Filed: Dec. 7, 2012

(86) PCT No.: PCT/IB2012/002639

§ 371 (c)(1),
(2) Date: Jun. 20, 2014

(87) PCT Pub. No.: WO2013/098616

PCT Pub. Date: Jul. 4, 2013

(65) Prior Publication Data

US 2015/0008312 A1 Jan. 8, 2015

Related U.S. Application Data

(60) Provisional application No. 61/580,489, filed on Dec. 27, 2011.

(51) Int. Cl.
*H01J 49/00* (2006.01)
*H01J 49/10* (2006.01)

(52) U.S. Cl.
CPC ..... *H01J 49/0072* (2013.01); *H01J 49/0077* (2013.01); *H01J 49/10* (2013.01); *H01J 49/107* (2013.01)

(58) Field of Classification Search
USPC ..... 250/282, 288
See application file for complete search history.

(56) References Cited

U.S. PATENT DOCUMENTS

| | | | | |
|---|---|---|---|---|
| 8,084,736 | B2 * | 12/2011 | Schneider | H01J 49/004 250/282 |
| 8,188,423 | B2 * | 5/2012 | Doroshenko | H01J 49/0045 250/281 |
| 8,283,626 | B2 * | 10/2012 | Brown | H01J 49/0072 250/281 |
| 2004/0173740 | A1 | 9/2004 | McLuckey et al. | |
| 2006/0255261 | A1 * | 11/2006 | Whitehouse | H01J 49/0431 250/288 |
| 2007/0176098 | A1 | 8/2007 | Wells | |
| 2009/0127453 | A1 | 5/2009 | Ding et al. | |
| 2009/0152458 | A1 | 6/2009 | Vilkov et al. | |
| 2009/0294649 | A1 | 12/2009 | Shabanowitz et al. | |
| 2009/0294650 | A1 | 12/2009 | Schneider et al. | |
| 2011/0186733 | A1 | 8/2011 | Schwartz | |

OTHER PUBLICATIONS

Campbell, J. Larry et al., "On Performing Simultaneous Electron Transfer Dissociation and Collision-Induced Dissociation on Multiply Protonated Peptides in a Linear Ion Trap", J. Am. Soc. Mass Spectrom. 2009, 20, 1672-1683.

(Continued)

*Primary Examiner* — Phillip A Johnston

(57) ABSTRACT

An apparatus, system and method of providing that allow for the generation of reagent ions within an inner region of a mass spectrometer for use in ion-ion reactions such as PTRs and ETD using a reagent ion generator. The location where these reagent ions are generated can be as close as possible to the point of action, or the reaction zone where the reagent ion and analyte ions will interact via ion-ion reactions to cause, e.g., PTRs and/or ETD.

8 Claims, 5 Drawing Sheets

(56) References Cited

OTHER PUBLICATIONS

Campbell J. Larry et al., "Targeted Ion Parking for the Quantitation of Biotherapeutic Proteins: Concepts and Preliminary Data", J. Am. Soc. Mass Spectrom. 2010, 21, 2011-2022.

Teng-Yi Huang et al: "Electron-Transfer Reagent Anion Formation via Electrospray Ionization and Collision-Induced Dissociation", Analytical Chemistry, vol. 78, No. 21, Nov. 1, 2006, pp. 7387-7391.

European Search Opinion in EP Application 12 86 2271, Jul. 15, 2015.

* cited by examiner

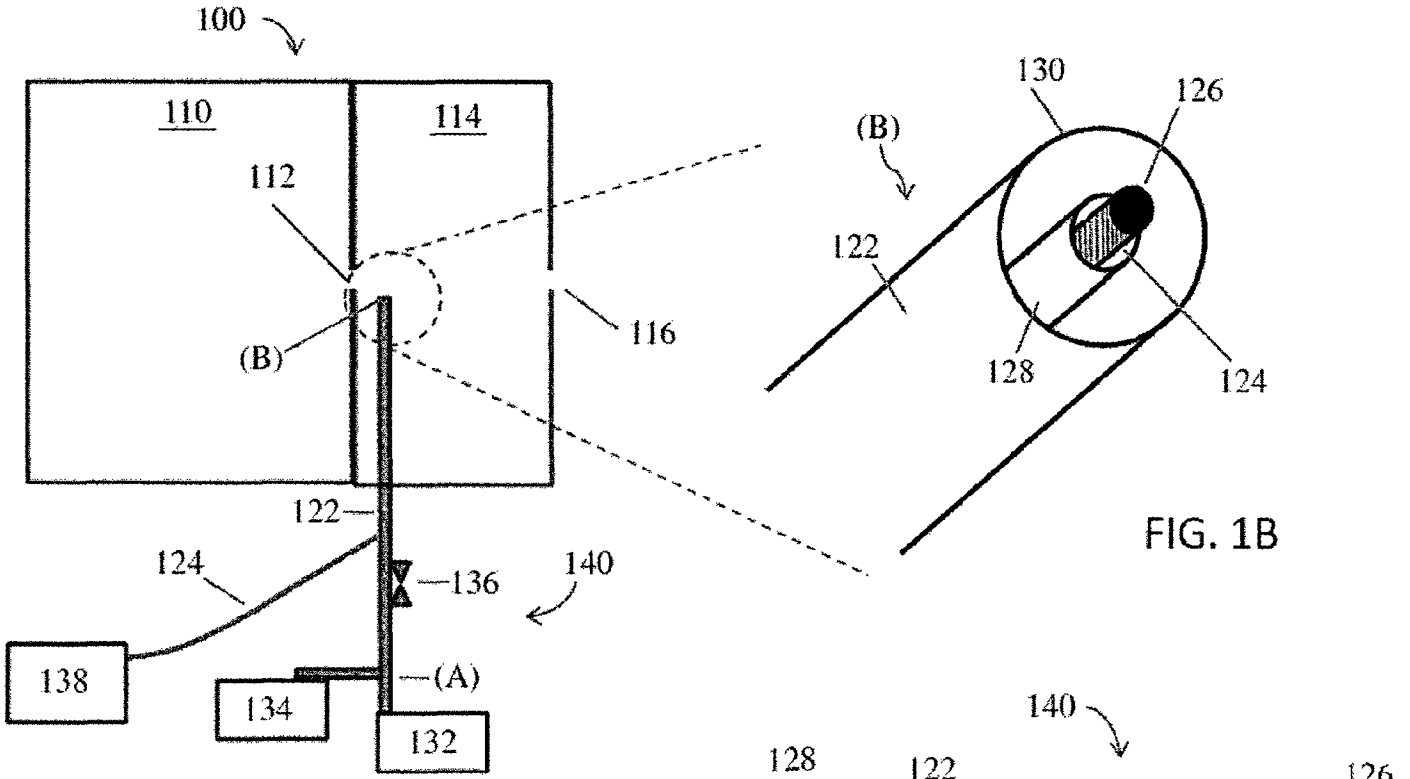
FIG. 1A
FIG. 1B
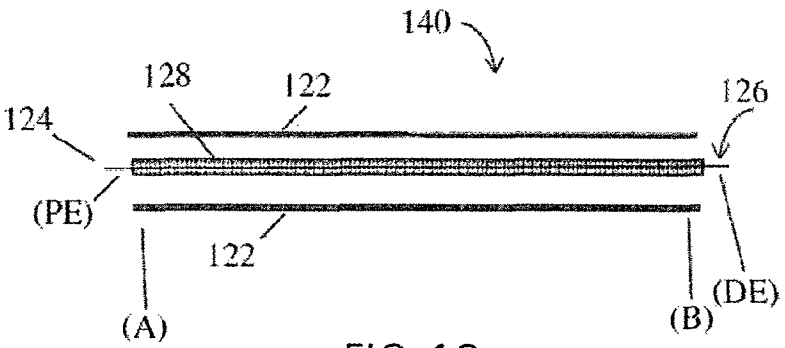
FIG. 1C

GENERATION OF REAGENT IONS FOR ION-ION REACTIONS

RELATED APPLICATION

This application claims the benefit and priority of U.S. Provisional Application Ser. No. 61/580,489, filed on Dec. 27, 2011, the entire contents of which is incorporated by reference herein.

FIELD

Applicant's teachings relate to generating reagent ions for ion-ion reactions in a chamber which can include a mass spectrometer.

INTRODUCTION

The ability to form gaseous multiply charged high mass ions suitable for mass spectrometry analysis has allowed for the mass spectrometric characterization of these species using ion-ion chemistry. Generally, reagent ions for ion-ion reactions are generated either in a devoted ion source or at atmospheric pressure in a dual function ion source (see, e.g., Campbell et al., J. Am. Soc. Mass Spectrom. 2009, 20, 1672-1683). The generated reagent ions need to be transported (e.g., via vacuum drag and/or an applied electric field) to a region of the mass spectrometer where the ion-ion reaction is to take place ("point-of-action"). In many cases, conventional methods of reagent ion generation and subsequent delivery to the point-of-action can increase overall cycle time of mass analysis, and in some cases can require hardware modifications (e.g., bipolar ion optics, additional chemical ionization sources and transport optics, etc.). Additionally, in some cases, a portion of the generated ions can be lost (e.g., due to impact with various surfaces) during delivery from the ion source to the point-of-action. Thus, enhanced systems and methods for performing mass analysis using ion-ion chemistry are desired.

SUMMARY

In accordance with one broad aspect, certain embodiments of the present invention relate to a mass spectrometer system and a method of operating the mass spectrometer system. The system and methods allow for the generation of reagent ions for use in ion-ion reactions such as proton-transfer reactions (PTR) (see, e.g., Campbell and Le Blanc, J. Am. Soc. Mass Spectrom. 2010, 21, 2011-2022) and electron transfer dissociation (ETD) (see, e.g., Campbell et al., J. Am. Soc. Mass Spectrom. 2009, 20, 1672-1683).

In some embodiments, there is provided a device for generating ions in a mass spectrometer, which comprises: a hollow conduit extending from a first end to a second end, where said first end is adapted for introduction of reagent molecules into the hollow conduit and said second end is adapted for positioning in an inner region of the spectrometer. The device can further comprise an electrically conducting wire that extends from a proximal portion to a distal tip portion. The wire is disposed in the hollow conduit such that its distal tip portion is positioned in proximity to said second end of the conduit. An electrically insulating jacket surrounds at least a length portion of the wire other than said distal tip portion. A voltage source adapted for coupling to a portion of the wire, e.g., its proximal portion, can apply a voltage to said wire so as to cause a discharge in proximity of said distal tip portion, thereby ionizing at least a portion of said reagent molecules in proximity to said distal end of the conduit. In other embodiments, the hollow conduit is formed of an electrically conductive material.

In further aspects, a mass spectrometer system is disclosed, which comprises a first chamber and a reagent ion generator that is coupled to the chamber. The reagent ion generator can comprise a hollow conduit that extends from a proximal end to a distal end. The proximal end is adapted for introducing reagent molecules from a source into the hollow conduit and the distal end is disposed inside said first chamber. The ion generator can further comprise an electrically conducting wire that is disposed at least partially within said hollow conduit and extends from a proximal portion to a distal tip portion, where the distal tip portion is positioned in proximity to said distal end of the conduit. The mass spectrometer can further comprise a voltage source adapted for electrically coupling to a portion of the wire, e.g., its proximal portion, for applying a voltage to the wire sufficient for causing an electric discharge, e.g., a corona discharge, in proximity of said distal portion of the wire. In some embodiments, the wire can be covered by an electrically insulating material over a length portion thereof other than said distal tip portion. In some embodiments, the chamber is maintained at a pressure of at least one atmosphere.

In some embodiments, the voltage source can apply a voltage in a range of about −5000 (minus 5000) volts (V) to about +5000 V to the conducting wire for generating said electric discharge. In some embodiments, the voltage is from about 1000 volts (V) to about 5000 V. In some embodiments, the voltage is from about −5000 volts (V) to about −1000 V.

A variety of reagents can be employed. By way of example, the reagent can comprise a volatile solid or liquid, or a gas. Some examples of suitable reagents comprise, without limitation, a perfluorocarbon and a polyaromatic hydrocarbon. In some embodiments, the reagent molecules form negative ions when they are exposed to said electric discharge.

In some embodiments, the mass spectrometer can further comprise an analyte conduit coupled to said first chamber for delivering analyte ions thereto, wherein at least a portion of said analyte ions undergo ion-ion reactions with said reagent ions.

In some embodiments, the mass spectrometer can further comprise a second chamber that is in communication with the first chamber, e.g., via an orifice. In some embodiments, the distal end of the hollow conduit is disposed in proximity of said orifice to allow delivering the reagent molecules to said first chamber in vicinity of said orifice.

In some embodiments, the first chamber can comprise a differential mobility spectrometer (DMS). The analyte conduit can be configured to provide analyte ions to an input port of the DMS. In some embodiments, the first chamber comprising the DMS can be in communication with the second chamber via an orifice such that at least a portion of the analyte ions that exit the DMS are directed to that orifice. In some embodiments, the ion generator is configured to generate an electric discharge in a region between the output port of the DMS and said orifice to cause ionization of reagents molecule and facilitate ion-ion reactions between those ionized reagent molecules and the analyte ions exiting the DMS. In some embodiments, the hollow conduit of the ion generator is configured as a throttle gas line terminating in proximity of said orifice, which connects the first chamber to the second chamber.

In further aspects, a method of performing ion-ion reactions is disclosed, which comprises introducing a reagent from an external source to a chamber, exposing said reagent to an electric discharge within said chamber to cause ionization thereof, and introducing analyte ions into said chamber to cause ion-ion reactions between said analyte ions and said ionized reagent to generate reacted analyte ions. The reacted analyte ions can be directed to a detection system for analysis.

In further aspects, a device for generating ions is disclosed, which comprises a hollow conduit extending from a proximal end to a distal end, wherein said proximal end is adapted for introducing reagent molecules from a source into said conduit and the distal end is disposed inside a chamber. An electrically conducting wire is disposed at least partially within said hollow conduit and extends from a proximal portion to a distal tip portion, wherein said distal tip portion is positioned in proximity to the distal end of the conduit. The device can further comprise a voltage source adapted for electrically coupling to the wire, e.g., its proximal portion, for applying a voltage to said wire sufficient to cause an electric discharge in proximity of the distal tip portion of the wire.

In some embodiments, the reagent can comprise any of a volatile solid or liquid, or a gas. In some embodiments, the ionized analyte can comprise, but is not limited to, any of a charged protein, a charged peptide, a charged nucleic acid, a charged oligonucleotide, a charged oligosaccharide, or a charged carbohydrate.

In some embodiments, the reagent is introduced into said chamber without undergoing mass selection prior to its introduction to said chamber.

These and other features of the embodiments as will be apparent are set forth and described herein.

BRIEF DESCRIPTION OF THE DRAWINGS

A detailed description of various embodiments is provided herein below with reference, by way of example, to the following drawings. The skilled person in the art will understand that the drawings, described below, are for illustration purposes only. The drawings are not intended to limit the scope of the applicants' teachings in any way.

FIG. 1A schematically illustrates a reagent ion generator according to some embodiments of the applicants' teachings that is incorporated in a mass spectrometer.

FIG. 1B shows a portion of the reagent ion generator of FIG. 1A as a perspective view.

FIG. 1C shows a portion of the reagent ion generator of FIG. 1A as a cut-away view.

Figure 2:
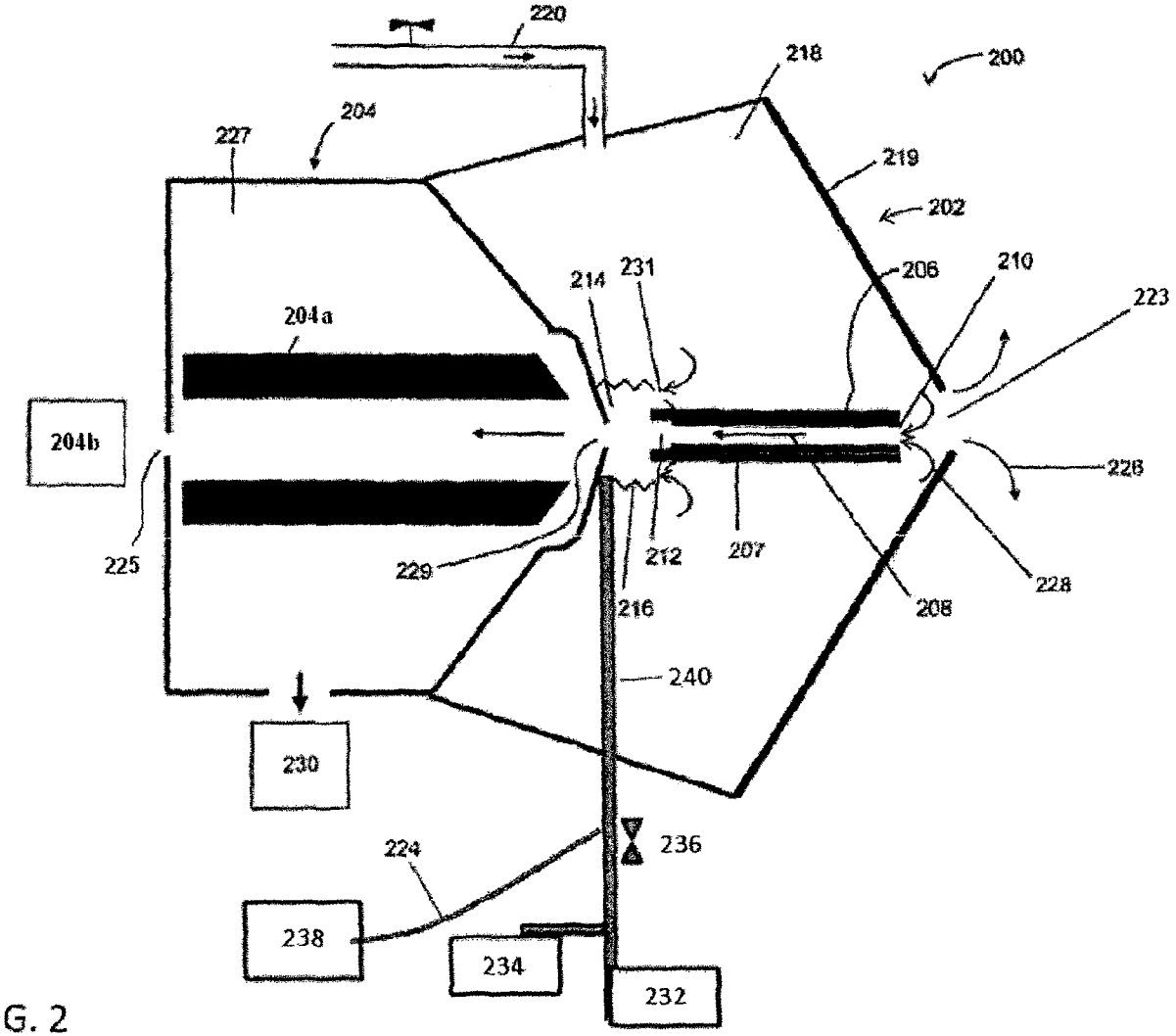
FIG. 2 schematically illustrates a differential mobility spectrometer/mass spectrometer system according to some embodiments of the present teachings.

It will be understood that the drawings are exemplary only and that all reference to the drawings is made for the purpose of illustration only, and is not intended to limit the scope of the embodiments described herein below in any way. For convenience, reference numerals may also be repeated (with or without an offset) throughout the figures to indicate analogous components or features.

DETAILED DESCRIPTION OF VARIOUS EMBODIMENTS

It will be appreciated that for clarity, the following discussion will explicate various aspects of embodiments of the invention, but omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the invention may not require certain of the specifically described details in every implementation, which are set forth herein only to provide a thorough understanding of the embodiments. Similarly it will be apparent that the described embodiments may be susceptible to slight alteration or variation according to common general knowledge without departing from the scope of the disclosure. The following detailed description of embodiments is not to be regarded as limiting the scope of the present invention in any manner.

FIG. 1A schematically depicts an reagent ion generator device 140 according to an embodiment of the applicants' teachings that is coupled to a chamber 114 of a mass spectrometer system 100 (shown only partially) according to the applicants' teachings. The illustrative system 100 comprises a chamber 110 connected through an orifice 112 to the chamber 114, which is in turn connected, through an orifice 116 to another, for example, chamber or an ion source. The reagent ion generator 140 extends from a first end (A) to a second end (B), where the first end (A) is external to the chamber 114 and the second end is disposed in the chamber 114.

As shown schematically in FIGS. 1B and 1C, the ion generator 140 comprises a hollow conduit 122, e.g., a tube in this illustrative embodiment, that extends from the first end (A) to the second end (B). An electrically conducting wire 124 is disposed within the tube 122 and extends along the length of the tube from a proximal end (PE) to a distal end (DE). As discussed in more detail below, a proximal end, or another portion offset from its distal tip portion 126, of the wire can be electrically coupled to a voltage source and its distal tip portion 126 can be exposed to the inner volume of the chamber. In some embodiments, the electrically conducting wire can comprise a thin wire. In some embodiments, the electrically conductive wire can have a diameter in a range of about 0.1 and about 3 mm. The term "electrically conducting wire" is used herein to refer generally to an elongate electrically conducting element. While such an elongate electrically conducting element can have in some cases a circular cross section, in other cases, it can have a cross section having another shape, e.g., square, rectangular, etc.

The conducting wire 124 is surrounded along at least a portion of its length by an electrical insulator 128. The insulator 128 does not, however, surround the distal tip portion 126 of the wire to allow generating an electric discharge in the vicinity of that tip portion in response to application of a high voltage to another portion of the wire, e.g., its proximal portion, as discussed further below. In some embodiments, the exposed distal tip portion of the wire can have a length of approximately 0.5, 1, 1.5, 2, 2.5, 3, 3.5, or 4 mm. The wire tip 126 may be flush with the end of the outer tube 122 or may be slightly inset or alternatively slightly protruding. (In some embodiments, a slightly protruding tip 126 can extend approximately 0.5, 1, 1.5, 2, 2.5, or 3 mm beyond the end of the outer tube 122 and a slightly inset tip 126 can be located approximately 0.5, 1, 1.5, 2, 2.5, or 3 mm before the end of the outer tube 122.) The wire may be formed of any electrically conducting material such as a conductive metal (e.g., copper). In some embodiments, the outer tube 122 can be, for example, a Teflon® tube having an outer diameter of between about 2 and about 10 mm and an inner diameter of between about 0.1 and about 4 mm. In some embodiments, the outer tube 122 can be cylindrical, or it can have an oval cross-section, or it may have one or more flat sides.

The outer tube 122 of the reagent ion generator 140 can receive at its first end reagent molecules, e.g., from a reagent source 132. In the illustrative embodiment of FIG. 1A, a carrier gas supplied by a source 134 is employed to facilitate the introduction of the reagent molecules into the reagent ion generator 140 via the first end. In some embodiments, the carrier gas and reagent molecules are mixed within the source of reagent molecules 132. Optionally, the outer tube 122 can terminate in a "T" juncture or a "Y" juncture prior to the source of reagent molecules 132 to provide a separate source of the reagent ions and a carrier gas 134 to the reagent ion generator 140. The flow rate of the carrier gas containing the reagent molecules through the reagent ion generator 140 can be controlled by a valve 136. Additionally or alternatively, the reagent ion source 132 and carrier gas source 134 may be individually controlled and metered to provide a desired flow rate of the carrier gas in the hollow tube 122 as well as a desired concentration of the reagent molecules in the carrier gas. In some embodiments, the reagent molecules can be introduced into the carrier gas in vapor phase. A variety of gases can be employed as the carrier gas. For example, in some embodiments, the carrier gas can be nitrogen. In some embodiments, the flow rate is between about 0.1 psi to about 100 psi and the concentration is about 0.1% (v/v) to about 100% (v/v) in the carrier gas.

Outside the chamber 114, the proximal end of the conducting wire 124 is electrically connected to a voltage supply 138 that is capable of supplying an electric potential to the conducting wire.

In use, the reagent molecules can be introduced into the hollow tube 122 at its first end, e.g., via a carrier gas, to be delivered to the second end of the tube. The application of a high electric potential, e.g., in a range of about 1000V to about 5000 V, can cause the generation of an electric discharge (e.g., a corona discharge) in the vicinity of the second end of the conductive wire within the chamber 114. The insulator 128 can help prevent generation of an electric discharge within the tube 122. The reagent molecules are exposed to the electric discharge and are ionized to generate charged reagent ions in the vicinity of the second end tube.

In some embodiments, analyte ions can be introduced into the chamber 114 via the orifice 116 to interact with the charged reagent ions generated in the vicinity of the orifice 112, e.g., via ion-ion reactions. In some embodiments, such ion-ion reactions can result in transfer of charge between the charged reagent molecules and the analyte ions, which in some cases can lead to the fragmentation of the analyte ions. Some types of ion-ion reaction that can occur include: (1) electrons are donated to the analyte ions, or (2) protons are removed from the analyte ions, or (3) protons are donated to the analyte ions, or (4) electrons are removed from the analyte ions. The analyte ions, and/or fragments thereof, can then flow through the orifice 112 into the chamber 110, e.g., for mass analysis.

In some embodiments, the reagent molecules can be ionized, via an electric discharge generated at the distal tip of the conducting wire, in the vicinity of the orifice 116 of the chamber 114 (e.g., a differential mobility spectrometer chamber) to interact, e.g., via ion-ion interactions, with analyte ions prior to their entry into the mass spectrometer chamber 110. In some embodiments, such interactions can result in proton-transfer reactions (PTR) or electron transfer dissociation (ETD) of the analyte ions prior to their entry into the mass spectrometer chamber 110. Electron transfer dissociation (ETD) is known for its ability to provide biomolecule sequencing information that is complementary to traditional collision induced dissociation (CID) based methods. The ability of ETD to sequence peptides and proteins, while retaining very labile posttranslational modifications (PTMs), is extremely useful.

A reagent ion generator according to the applicants' teachings, such as the above reagent ion generator, can be incorporated in a variety of different mass spectrometers. By way of example, referring to FIG. 2, there is illustrated in a schematic view, a differential mobility spectrometer/mass spectrometer system 200 in accordance with an aspect of several embodiments of the applicants' teachings. In the illustrated embodiment, the differential mobility spectrometer/mass spectrometer system 200 comprises a differential mobility spectrometer 202, which is coupled to a downstream mass spectrometer 204 via an orifice 229. The mass spectrometer 204 comprises a vacuum chamber 227 in which a vacuum lens element 204*a* is disposed and is in communication with a subsequent stage of the mass spectrometer 204 (in this embodiment, a mass analyzer 204*b*) via another orifice 225. Ions can be transported through vacuum chamber 227 and may be transported through one or more additional differentially pumped vacuum stages (not shown) prior to the mass analyzer 204*b*. For instance, in some embodiments, a triple quadrupole mass spectrometer may comprise three differentially pumped vacuum stages, including a first stage maintained at a pressure of approximately 2.3 Torr, a second stage maintained at a pressure of approximately 6 mTorr, and a third stage maintained at a pressure of approximately $10^{-5}$ Torr. The third vacuum stage may contain a detector, as well as two quadrupole mass analyzers with a collision cell located between them. It will be apparent to those of skill in the art that there may be a number of other ion optical elements in the systems that have not been described. This example is not meant to be limiting as it will also be apparent to those of skill in the art that the differential mobility spectrometer/mass spectrometer is one example of a spectrometer to which a reagent ion generator according to the present teachings can be coupled, including those that sample ions from elevated pressure sources. Some examples of such spectrometers can comprise time-of-flight (TOF), ion trap, quadrupole, or other mass analyzers as known in the art.

The differential mobility spectrometer 202 comprises electrically conductive plates (electrodes) 206 and an electrical insulator 207 disposed along an outer surface of each of the plates 206. The insulator 207 supports the electrodes and isolates them from other conductive elements. For example, the insulator may be fabricated from ceramic or Teflon®. A drift gas 208 can be introduced via an inlet 210 of the differential mobility spectrometer into a volume between the plates and can flow to an outlet 212. The outlet 212 of the differential mobility spectrometer 202 releases the drift gas into a juncture or baffle chamber 214 defined by baffles 216, which juncture chamber 214 defines a path of travel for ions between the differential mobility spectrometer 202 and the mass spectrometer 204. In some embodiments, the outlet 212 of the differential mobility spectrometer 202 is aligned with the inlet 229 of the mass spectrometer 204 to define the ions' path of travel, while the baffles 216 are spaced from this path of travel to limit interference of the baffles 216 with the ions traveling along the path of travel.

In this illustrative embodiment, the differential mobility spectrometer 202 comprises a curtain chamber 218, defined by curtain plate (boundary member) 219 and supplied with a curtain gas from a curtain gas source 220. The curtain gas source 220 provides the curtain gas to the interior of the curtain chamber 218. Ions are provided from an ion source (not shown) and are emitted into the curtain chamber 218 via curtain chamber inlet 223. The pressure of the curtain gas within the curtain chamber 218 provides both a curtain gas outflow 226 out of curtain gas chamber inlet 223, as well as a curtain gas inflow 228 into the differential mobility spectrometer 202, which inflow 228 becomes the drift gas 208 that carries the analyte ions through the differential mobility spectrometer 202 and into the juncture chamber 214. The curtain plate 219 may be connected to a power supply to provide an adjustable DC potential to it.

The differential mobility spectrometer/mass spectrometer system 200 has a reagent ion generator 240 whose distal end is located in the juncture chamber 214. In this illustrated embodiment, the reagent ion generator 240 has the same structure as the above reagent ion generator 140 described in connection with FIGS. 1A, 1B and 1C. The reagent ion generator is connected at one end, disposed outside the curtain chamber 218, to a reagent molecule supply 232 which may be a combination of a reagent molecule supply and a collision gas supply. A power supply 238 can provide an adjustable DC potential to the conductive wire of the reagent ion generator to cause an electric discharge in the vicinity of its tip portion, which is disposed in the juncture chamber 214. This power supply may be the same as or different from the one supplying power to the DMS. The reagent ion generator 240 optionally comprises one or more controllable valves 236 that, in some embodiments, can be used to control the flow rate of the carrier gas containing the reagent molecules through the reagent ion generator 240 into the juncture chamber 214. In use, the application of high voltage to the conductive wire of the reagent ion generator 240 can cause an electric discharge within the juncture chamber 214 so as to ionize the reagent molecules supplied by the ion generator's conduit to the chamber 214. The flow rate of the carrier gas containing the reagent molecules through the reagent ion generator can be controlled by a valve 236

As shown in FIG. 2, the drift gas 208 carries the analyte ions through the differential mobility spectrometer 202 and into the juncture chamber 214. The vacuum chamber 227 can be maintained at a reduced pressure by a vacuum pump 230 while the curtain chamber 218 and an internal operating pressure of the differential mobility spectrometer 202 can be maintained at atmospheric pressure or some other pressure. As a result of the significant pressure differential between the curtain chamber 218 and the vacuum chamber 227, the drift gas 208 is drawn through the differential mobility spectrometer 202, the juncture chamber 214 and, via vacuum chamber inlet 229, into the vacuum chamber 227 and first vacuum lens element 204*a*. As shown, the mass spectrometer 204 can be sealed to (or at least partially sealed), and in fluid communication with the differential mobility spectrometer 202, via the juncture chamber 214, to receive the analyte ions from the differential mobility spectrometer 202.

Figure 3:
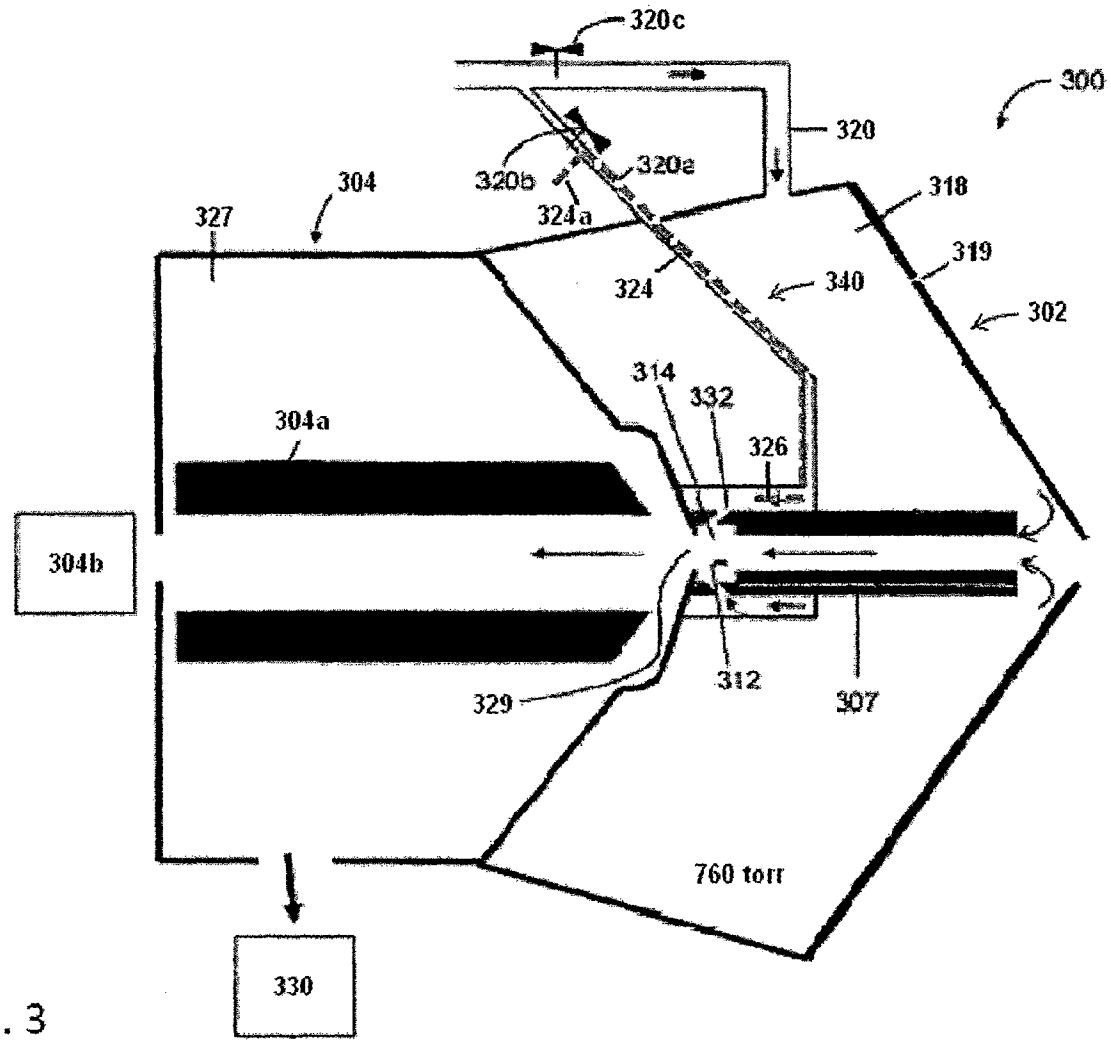
FIG. 3 schematically illustrates a differential mobility spectrometer/mass spectrometer system according to some embodiments of the present teachings.

As known in the art, RF voltages, often referred to as separation voltages (SV), can be applied across an ion transport chamber of a differential mobility spectrometer 202 perpendicular to the direction of drift gas 208 (shown in FIG. 3). The RF voltages may be applied to one or both of the electrically conductive plates 206 comprising the differential mobility spectrometer. The tendency of ions to migrate toward the walls and leave the path of the differential mobility spectrometer 202 can be corrected by a DC potential often referred to as a compensation voltage (CV). The compensation voltage may be generated by applying DC potentials to one or both of the electrically conductive plates 206 comprising the differential mobility spectrometer 202. As is known in the art, a voltage source (not shown) can be provided to provide both the RF SV and the DC CV. Alternatively, multiple voltage sources may be provided.

By controlling the residence time of the analyte ions and reagent ions within the differential mobility spectrometer 202, resolution and sensitivity can be adjusted such as by controlling the inflow of gas from the curtain chamber 218 can be controlled by controlling the size of the leak provided by the gas port 231.

Analyte ions exiting the differential mobility spectrometer 202 enter the juncture chamber 214 in which they interact with the charged reagent ions generated by the reagent ion generator 240. As noted above, in some cases, such ion-ion reactions can cause fragmentation of the analyte ions, e.g., via electron transfer dissociation (ETD). The analyte ions and/or fragments thereof are accelerated into the vacuum chamber 227 and into the mass analyzer element 204*a*. In some embodiments, the chamber 227 can be operated as a collision cell for ion-ion reactions between the analyte ions and reagent ions. In such embodiments, the reagent ions and the analyte ions can be drawn into the chamber 227, e.g., via a pressure differential between the chamber 227 and the juncture chamber 214. The analyte ions and the reagent ions can be trapped within the chamber 227 and undergo ion-ion reactions. As noted above, such ion-ion reactions can cause dissociation of the analyte ions, e.g., via ETD.

In this illustrated embodiment, the baffles 216 of the curtain chamber comprise a controlled leak or gas port 231 for admitting the curtain gas into the juncture chamber 214. Within the juncture chamber 214, the curtain gas becomes a throttle gas that throttles back the flow of the drift gas 208 through the differential mobility spectrometer 202. Specifically, the throttle gas within the juncture chamber 214 modifies a gas flow rate within the differential mobility spectrometer 202 and into the juncture chamber 214, thereby controlling the residence time of the analyte ions and reagent ions within the differential mobility spectrometer 202.

The baffles 216 can be configured to provide a randomizer surface member, and the gas port 231 can be oriented to direct the throttle gas at least somewhat against the baffles 216 and randomizer surface to disburse the throttle gas throughout the juncture chamber 214. In one embodiment, the gas port 231 introduces the throttle gas without disrupting the gas streamlines between the differential mobility spectrometer 202 and the mass spectrometer inlet 229.

Referring to FIG. 3, there is illustrated in a schematic view, a differential mobility spectrometer/mass spectrometer system 300 in accordance with some embodiments of the applicants' teachings. For clarity, the same reference numerals used in FIG. 2, with 100 added, are used in FIG. 3 to designate elements analogous to the elements of FIG. 2. For brevity, the description of FIG. 2 is not repeated with respect to FIG. 3. As with the system 200 of FIG. 2, in the system 300 of FIG. 3, a differential mobility spectrometer 302 is coupled to a vacuum chamber 327 of a mass spectrometer via an inlet 329. As with the system 200 of FIG. 1, the vacuum chamber 327 of the system 300 can be maintained at a reduced pressure while the pressure in the curtain chamber 318 can be maintained at a higher pressure, such as at atmospheric pressure.

As shown in FIG. 3, in this embodiment, the reagent ion generator 340 is implemented by employing the throttle gas line 320*a* of the differential mobility spectrometer 302 as the hollow conduit with the conducting wire 324 placed inside the throttle gas line 320*a*. The throttle gas line 320*a* extends to the juncture chamber 314, which is located between the differential mobility spectrometer 302 and the vacuum chamber inlet 329. In some embodiments, the "throttle gas," which can be doped with a volatile liquid, like perfluoromethyldecalin, can carry neutral reagent molecules to the junction chamber 314. The conductive wire 324 can extend through the throttle gas line 320*a* such that its exposed tip is located in vicinity of the juncture chamber 314. A proximal end 324*a* of the conductive wire 324 can be electrically coupled to a voltage source (not shown) for application of a high voltage thereto. As in the previous embodiment, an electrical insulator can cover the wire along most of its length, e.g., other than proximal portion and its distal bare tip. The insulator can ensure that an electrical discharge generated in response to application of a high voltage to the wire is substantially confined to the proximity of the distal bare tip 326 of the conducting wire 324. A reagent molecule source (not shown) can supply reagent molecules to the throttle gas line 320*a*. A carrier gas can facilitate the flow of the reagent molecules through the conduit. In the illustrated system 300 of FIG. 3, a common source is provided for both the curtain gas and the carrier gas used in the gas line 320*a*; however, separate sources may also be provided. For example, this gas could be nitrogen. The throttle gas flows through a conduit branch 320*a* into the juncture chamber 314. Optionally, the juncture chamber 314 may be designed with a larger diameter, and the gas port 332 may be oriented such that the gas stream through the inlet is directed along the wall or provided in a cross-flow to the ion motion in the juncture chamber 314.

In use, the application of a high voltage to the conducting wire 324 can cause an electric discharge in the vicinity of the distal tip portion 326 of the conducting wire 324, which can in turn ionize the reagent molecules as they flow through the throttle gas line 320*a* past the distal tip 326 of the conducting wire 324.

In this illustrated embodiment, conduit branch 320*a* comprises a controllable valve 320*b* that can be used to control the rate of flow of the reagent molecules through the throttle gas line 320*a*.

In this illustrated embodiment, a valve 320*c* can control the rate of flow of the curtain gas into the curtain chamber 318. In some embodiments, controlling the curtain gas flow rate can ensure proper declustering of ions upstream of the differential mobility spectrometer 302. Clusters can have different motilities than dry ions, and can therefore have different compensation voltage (CV) values. These clusters can be filtered and lost while transmitting an ion of interest, leading to reduced sensitivity. As shown in FIG. 3, the system may comprise a common gas supply to provide both the curtain gas and the throttle gas flows, or it may have separate supplies.

The analyte ions exiting the differential mobility spectrometer 302 can interact with the reagent ions entering the juncture chamber 314 via the throttle gas line 320*a* prior to entering the vacuum chamber 327 of a mass spectrometer through the orifice 329. In some embodiments, the orifice 329 can have a circular shape to ensure high transmission efficiency through subsequent vacuum stages and lenses.

Figure 4:
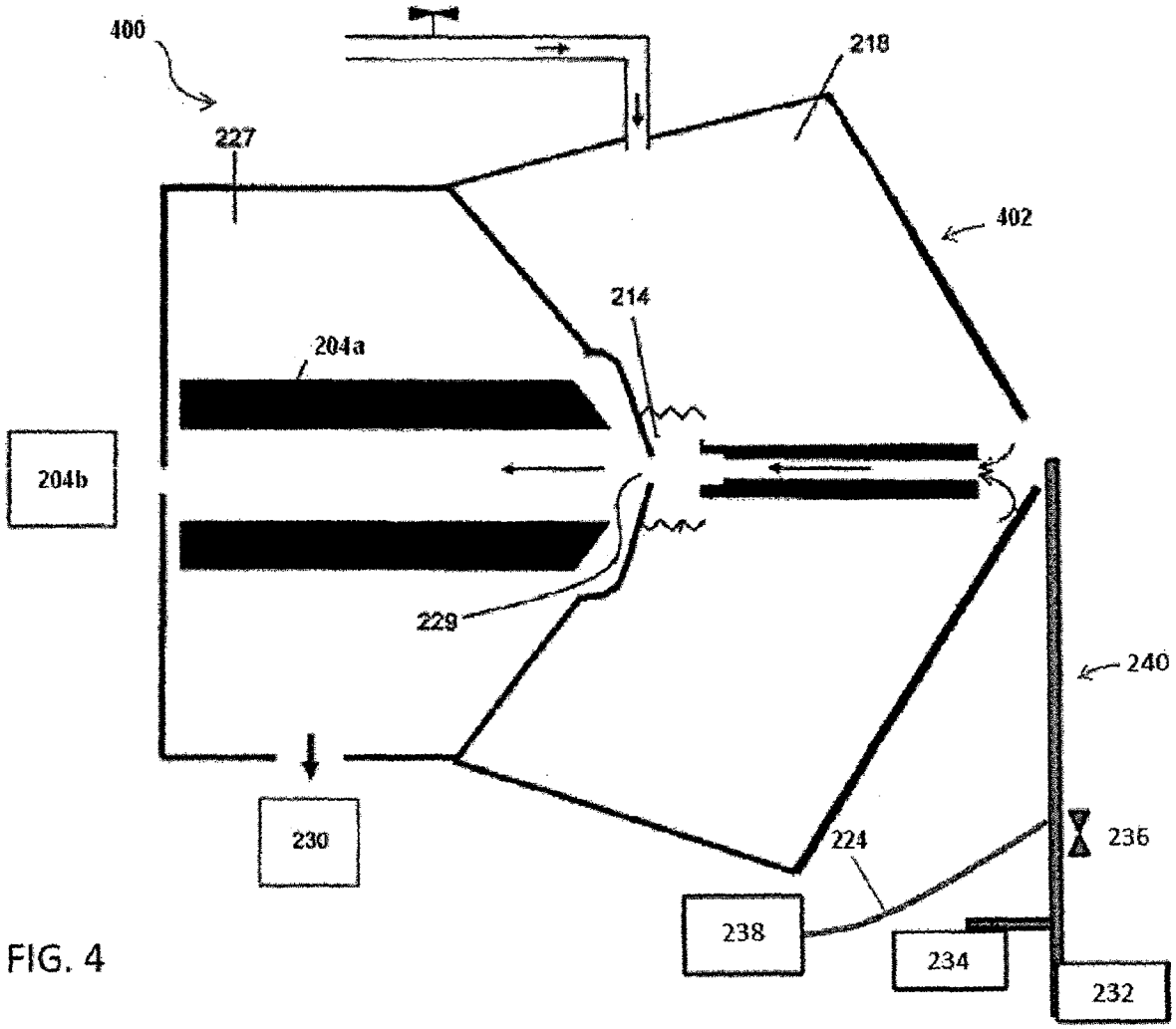
FIG. 4 schematically illustrates a differential mobility spectrometer/mass spectrometer system according to some embodiments of the present teachings.

Referring to FIG. 4, there is illustrated in a schematic view, a differential mobility spectrometer/mass spectrometer system 400 in accordance with several embodiments of the applicants' teachings. This differential mobility spectrometer/mass spectrometer system 400 is similar to the differential mobility spectrometer/mass spectrometer system 200 of FIG. 2 and hence the same reference numbers as those in FIG. 2 are used herein to refer to its various elements. For brevity, the description of FIG. 2 is not repeated with respect to FIG. 4. The illustrated differential mobility spectrometer/mass spectrometer system 400 comprises a reagent ion generator 240 with an end located just outside the curtain chamber 218. Outside of the differential mobility spectrometer 402, the outer tube of the reagent ion generator 240 is connected to a source of reagent molecules 232 and optionally a carrier gas source 234. Optionally, the outer tube terminates in a "T" juncture or a "Y" juncture prior to the source of reagent molecules 232 to provide a separate source of the reagent ions and a carrier gas 234 to the reagent ion generator 240. The flow rate for the reagent molecules through the reagent ion generator can be controlled by a valve 236. Additionally or alternatively, the flow rate of the reagent molecules and the carrier gas can be controlled by separate control and metering of the reagent source 232 and carrier gas source 234. Outside the differential mobility spectrometer 402, the proximal end of conducting wire of the reagent ion generator is threaded is connected to a power supply 238 that is capable of applying an electrical potential to the conducting wire.

Thus, there is provided an apparatus, system, and methods that allow for the generation of reagent ions within an inner region of a mass spectrometer for use in ion-ion reactions such as PTR and ETD. The location where these reagent ions are generated can be as close as possible to the point-of-action, or can be the reaction zone itself where the reagent ions and analyte ions will interact via in ion-ion reactions, such as PTRs and/or ETD. In some embodiments, the system and methods as described herein are particularly useful for analyzing large molecules, including one or more of a protein, peptide, nucleic acid, oligonucleotide, oligosaccharide, and a carbohydrate.

Reagent Ions

A variety of compounds can be employed as the reagent molecules. For example, in some embodiments, the compound can be volatile and capable of ionizing at a voltage of, for example, between 1000 and 5000 V.

In other embodiments, the reagent ion can be generated from any volatile compound (reagent molecule) known to be useful for ion-ion reactions.

In some embodiments, perfluorocarbon molecules are particularly useful for generating ions for reactions involving proton transfer with multiply protonated peptides and proteins. Reagent molecules, such as perfluoromethyldeclin and perfluorooctanol, are exemplary precursor molecules to reagent ions used for PTRs. In other embodiments, aromatic molecules which can include hydrocarbons, such as anthracene, azobenzene, azulene, nitrobenzene, dinitrobenzene, and fluoranthene, can be employed as precursor molecules to reagent ions used for ETD. In other embodiments, the reagent molecule can be a carboxylic acid, such as 9-anthracenecarboxylic acid. In other embodiments, the aromatic molecules can comprise heteroatoms.

Ionization

In some embodiments, the application of several kilovolts of potential to the conducting wire 124 (see, for example, FIG. 1) of various embodiments of a reagent ion generator 140 according the applicants' teachings can result in a small discharge (e.g., a corona discharge) at the tip of the conducting wire 126. In some embodiments, with neutral reagent molecules flowing over the tip of the conducting wire 126, gas-phase ions, such as cations and/or anions, can be produced. As discussed above, in various embodiments, the reagent ion generator 140 can be coupled to a mass spectrometer 100 such that the reagent ions are generated at, or close to, the point-of-action to undergo, e.g., ion-ion reactions, with a plurality of analyte ions.

In some embodiments, the electric potential applied to the conducting wire 124 can be in a range of about −5000 V (minus 5000 V) to about −1000 V (minus 1000 V) or about 1000 to about 5000 V. In some embodiments, the electric potential applied to the conducting wire 124 can be between about −4000 (minus 4000 V) and about −2000 V (minus 2000 V) or between about +2000 and about +4000 V. In some embodiments, an electric potential of approximately −3000 V can be applied to the wire.

In various embodiments, the reagent ion generator 140 according to the applicants' teachings can be employed to obtain a relatively pure population of reagent ions. Thus, in some embodiments, no mass selection of the reagent ions will be required prior to ion-ion reactions. In some embodiments, the relatively pure population comprises at least 40%, 50%, 60%, 70%, 80% or 90% of a single ionic species. In other embodiments, relatively pure population comprises at least 40%, 50%, 60%, 70%, 80% or 90% of two or three related ion species.

The ion-ion reaction chemistry as disclosed herein is useful for obtaining mass information of intact molecules and bond connectivity within the molecule can be derived via the dissociation of the precursor ions. Thus, in some embodiments, molecules including biopolymers including proteins, peptides, nucleic acids, oligonucleotides, polysaccharides, and oligosaccharides may be analyzed. The identification and analysis of these biopolymers are dependent on a sufficient amount of fragments and diversity in the fragmentation patterns which can be obtained by using the reagent ion generator according to the applicants' teachings.

While the above description provides examples and specific details of various embodiments, it will be appreciated that some features and/or functions of the described embodiments admit to modification without departing from the scope of the described embodiments. The above description is intended to be illustrative of the invention, the scope of which is limited only by the language of the claims appended hereto.

EXAMPLES

Aspects of the applicants' teachings may be further understood in light of the following examples, which should not be construed as limiting the scope of the applicants' teachings in any way.

Example 1

Figure 5A:
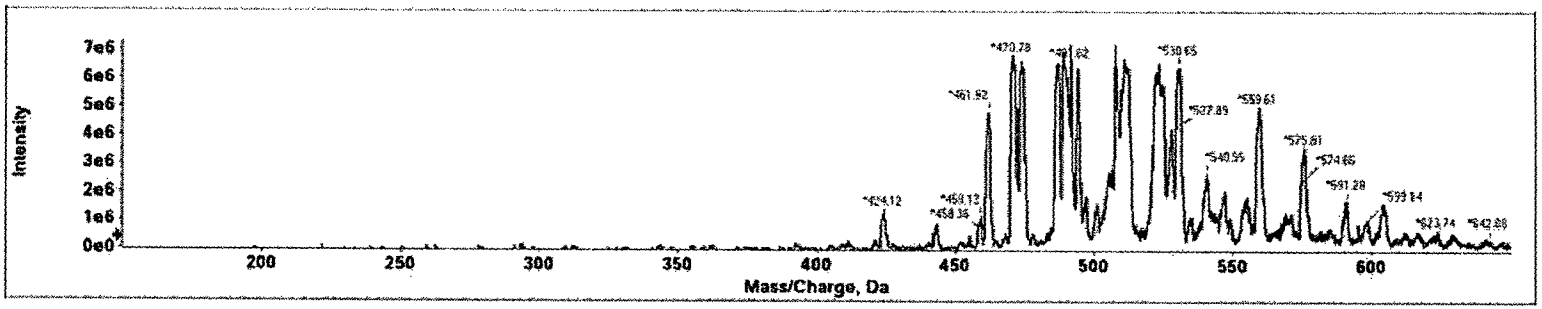
FIG. 5A shows an m/z scan of a plurality of ions generated by passing a vapor of perfluoromethyldecalin through a reagent ion generator in accordance with the present teachings, which was positioned to have an end near the orifice of a 4000 QTRAP® spectrometer system.
Figure 5B:
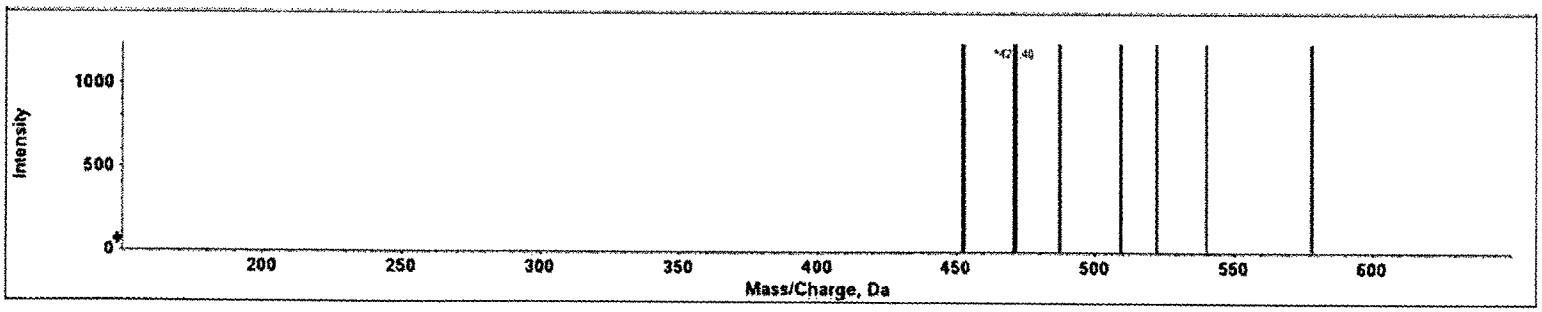
FIG. 5B shows an m/z scan when the voltage applied to the ion generator mentioned above in connection with FIG. 5A was set to 0 V.

A flow of perfluoromethyldecalin vapor was established through a reagent ion generator according to the teachings herein having an end near the orifice of a 4000 QTRAP® spectrometer system. The conducting wire of the reagent ion generated was a Teflon® insulated wire, where a 2-mm length of the insulating layer was removed from an end thereof to provide an exposed distal tip. An electric potential of −3000 V was applied to the proximal end of the wire while perfluoromethyldecalin vapor was flowing through the conduit of the reagent ion generator. FIG. 5A shows an m/z scan of the unfiltered perfluoromethyldecalin and perfluoromethyldecalin structural analogs having a range of molecular weights of between approximately 450 and 600 Da, demonstrating that a variety of ions are produced which would be available for ion-ion reactions with analyte ions. FIG. 5B provides an m/z scan when the voltage applied to the reagent ion generator was set to 0 V (the spurious peaks within FIG. 5B are electronic noise).

The section headings used herein are for organizational purposes only and are not to be construed as limiting the subject matter described in any way.

While the applicants' teachings are described in conjunction with various embodiments, it is not intended that the applicants' teachings be limited to such embodiments. On the contrary, the applicants' teachings encompass various alternatives, modifications, and equivalents, as will be appreciated by those of skill in the art.

The invention claimed is:

1. A mass spectrometer system, comprising:

a first chamber, a second chamber disposed between a differential mobility spectrometer and a vacuum chamber inlet;

a reagent ion generator coupled to said second chamber, said ion generator comprising:

a hollow conduit extending from a proximal end to a distal end, wherein said proximal end is adapted for introducing reagent molecules from a source into said conduit and said distal end extending to said second chamber, and an electrically conducting wire disposed at least partially within said hollow conduit and extending from a proximal portion to a distal tip portion, wherein said distal tip portion is positioned in proximity to said distal end of the conduit, and a voltage source adapted for electrically coupling to a portion of the wire for applying a voltage to said wire sufficient for causing an electric discharge in proximity of said distal tip portion of the wire;

and wherein said first chamber is maintained at an atmospheric pressure and said second chamber is maintained at a reduced pressure and said hollow conduit is configured as a throttle gas line that terminates in a gas port that fluidly connects said hollow conduit to said second chamber.

2. The mass spectrometer system of claim 1, wherein said voltage source is adapted to apply a voltage between about −5000 and about +5000 volts to the conducting wire.

3. The mass spectrometer system of claim 1, wherein said wire is covered by an electrically insulating material over a length portion thereof other than said distal tip portion.

4. The mass spectrometer system of claim 1, wherein said reagent molecules comprise any of a perfluorocarbon or an aromatic molecule.

5. The mass spectrometer system of claim 1, wherein said reagent molecules form positive ions when exposed to a discharge and/or corona from the exposed tip of the conducting wire.

6. The mass spectrometer system of claim 1, wherein said reagent molecules form negative ions when exposed to a discharge and/or corona from the exposed tip of the conducting wire.

7. The mass spectrometer of claim 1, wherein said first chamber is maintained at a pressure of at least one atmosphere.

8. The mass spectrometer system of claim 1, further comprising an analyte conduit coupled to said first chamber for delivering analyte ions thereto, wherein at least a portion of said analyte ions undergo ion-ion reactions with said reagent ions.

* * * * *